United States Patent [19]

Priaroggia

[11] Patent Number: 4,602,121

[45] Date of Patent: Jul. 22, 1986

[54] OIL-FILLED ELECTRIC CABLE WITH ALTERNATE LAYERS OF PLASTIC AND PAPER TAPE INSULATION

[75] Inventor: Paolo G. Priaroggia, Milan, Italy

[73] Assignee: Societa' Cavi Pirelli S.p.A., Milan, Italy

[21] Appl. No.: 690,666

[22] Filed: Jan. 11, 1985

[30] Foreign Application Priority Data

Jan. 17, 1984 [IT] Italy ..... 19182 A/84

[51] Int. Cl.[4] ..... H01B 7/02; H01B 9/06

[52] U.S. Cl. ..... 174/25 R; 174/26 R; 174/120 FP

[58] Field of Search ..... 174/25 R, 26 R, 120 FP

[56] References Cited

U.S. PATENT DOCUMENTS

| | | | |
|---|---|---|---|
| 2,709,197 | 5/1955 | Davey | 174/25 R |
| 3,194,871 | 7/1965 | Garner et al. | 174/25 R |
| 3,662,092 | 5/1972 | Franco | 174/120 FP |
| 3,749,812 | 7/1973 | Reynolds et al. | 174/25 R |
| 3,844,860 | 10/1974 | Edwards | 174/25 R X |
| 4,237,334 | 12/1980 | Kojima et al. | 174/120 FP X |

FOREIGN PATENT DOCUMENTS

| | | | |
|---|---|---|---|
| 1494 | 4/1979 | European Pat. Off. | 174/25 R |
| 14900 | 2/1977 | Japan | 174/25 R |
| 38888 | 8/1983 | Japan | 174/25 R |

OTHER PUBLICATIONS

Cheng, F. S. et al; Effect of Impregant on the Electrical and Mechanical Properties of Polypropylene Paper; Wire and Wire Products; May 1972; pp. 57–63.

*Primary Examiner*—Arthur T. Grimley
*Assistant Examiner*—Morris H. Nimmo
*Attorney, Agent, or Firm*—Brooks Haidt Haffner & Delahunty

[57] ABSTRACT

An oil-filled electric cable in which the solid insulation is formed, at least in part, by separately applied, alternate layers of cellulose paper tape and of film tapes made of a plastic. Prior to application of the tapes around the cable conductor, the moisture content of the paper tape is selected and the swelling of the plastic tape by the oil after application is adjusted, if necessary, such as by immersing the plastic tape in the oil prior to application, so that the swelling of the plastic tape by the oil in the formed cable is offset by the shrinkage of the paper tape during drying of the cable. Also, apparatus for pre-swelling the plastic tape.

8 Claims, 4 Drawing Figures

OIL-FILLED ELECTRIC CABLE WITH ALTERNATE LAYERS OF PLASTIC AND PAPER TAPE INSULATION

The present invention relates to an improved oil-filled electric cable, both a single-core cable and a multi-core cable, and in particular it refers to an improvement of the solid, stratified insulation of an oil-filled cable.

In addition, the present invention relates to a method for carrying out the treatment of the solid, stratified insulation components of an oil-filled cable of the invention.

Oil-filled electric cables have the problem of reducing the dielectric losses so as to make the use thereof for voltages higher than 500 kV possible without making recourse to forced cooling operations of the cable itself.

This problem is particularly felt in the case of oil-filled submarine cables which, in addition to being of long lengths, permit the insertion of pumping stations, which are necessary for carrying out the forced cooling operation, only at the cable ends on the land.

In order to solve the problem, it has already been proposed to use, for the formation of the solid stratified insulations of the oil-filled cables, tapes of synthetic materials, such as plastic material, film tapes, which having a dielectric loss factor, tg $\delta$, smaller than that of the cellulose papers presently used, to produce a lowering of the dielectric losses.

But, owing to the difference in the mechanical characteristics between the cellulose paper tapes and the plastic material, film tapes, it has been impossible to realize oil-filled cables provided with solid stratified insulations formed only by windings of plastic material, film tapes.

In fact, in addition to the difficulties met with the carrying out of the windings of the plastic material film tapes, the obtained cables have a solid stratified insulation devoid of that transversal softness essential for the flexibility which is found in the known cables in which the solid stratified insulation is formed only by windings of cellulose paper tapes. The solid stratified insulations of the cables, formed only by windings of plastic material, film tapes, are in fact very compact and not very flexible causing the cables to have an undesirable bending stiffness.

Moreover, great difficulties have been found in the impregnation of such cables with the insulating fluid oil due to the low, if any, permeability of the plastic material, film tapes forming the solid stratified insulation.

Also, it has been observed that the plastic material, film tapes swell in a greater or smaller measure depending on the type of the plastic material in contact with the usual insulating fluid oils for cables, and the swelling of these tapes further increases the bending stiffness of the solid stratified insulation and consequently of the cable.

However, even if plastic material, film tapes which swell with the oils an amount which is such as to consider them, in practice, not capable of being swollen, it is not possible to reduce, with this type of tape, the bending stiffness of the cable due to the compactness of solid stratified insulation formed only by plastic material, film tapes in consequence of the mechanical characteristics of said tapes.

Also, the known proposals of making recourse to the use of plastic material, film tapes transversally corrugated or of using tapes made with mixtures of cellulose fibers and plastic fibers have not given the hoped for success due to the adverse mechanical characteristics of said tapes, and in the case of tapes of corrugated plastic material, film due to the presence of the large number of cavities filled with oil which form in the cable in correspondence to the corrugations of the tapes.

In order to solve the problem, it has been proposed to use tapes formed by a laminate of cellulose paper and plastic film closely joined or bonded together. See, for example, European patent application No. 0,001,494. However, this latter solution also has drawbacks.

In fact, the laminate, usually constituted by a film of plastic material sandwiched between two layers of cellulose paper, owing to the different nature of its components is subjected to wrinkles at the plane of union of the components every time that, for whatever cause, one of the components expands or shrinks, for example, in consequence of moisture or of absorption of oil.

The presence of wrinkles in the tapes of plastic-cellulose paper laminate forming the solid stratified insulation of a cable produces a reduction in its dielectric strength, and this makes it difficult to provide a cable to be used for high voltages. In this connection, it is to be kept in mind that it is very difficult to avoid the presence of wrinkles in the tapes of a plastic-cellulose paper laminate forming the solid stratified insulation of an oil-filled cable.

In fact, it is not to be ignored that in the manufacturing of the oil-filled cables, the solid stratified insulation is dried and impregnated with an insulating fluid oil. During the drying process of the solid stratified insulation of a cable formed with windings of tapes of a plastic-cellulose paper laminate, there are greater variations in the dimensions of cellulose paper than in the plastic component. On the other hand during the impregnation with the insulating fluid oil a swelling of the plastic takes place, i.e. there is an increase of the dimensions of the plastic component. These two phenomena are the cause of undulations in the laminate tapes forming the solid stratified insulation. Moreover, it is difficult to operate in such a way that the reduction in the dimensions, which takes place in the cellulose paper component of the laminate during the drying process, is perfectly counterbalanced by an equal increase of the dimensions which takes place in the plastic component of the laminate in consequence of the swelling that this latter suffers during the impregnation with the insulating fluid oil.

The attempts made to form the stratified insulation of a cable with plastic-cellulose paper laminates where the paper component was still damp so that the reduction in the dimensions suffered by it during the drying process is equalized by the increase of dimensions of the plastic component during the swelling that takes place through the impregnation with the insulating fluid oil have not been satisfactory.

Finally, the unavoidable imperfections of the plastic component of the laminate, such as, for example, the presence of microscopic bubbles or foreign particles and the like which, in practice, do not give a uniform dielectric strength, suggest that such laminates should not be used at those portions of the cable solid stratified insulation where the electric field is more intense, i.e. near the semi-conductive screen covering the cable conductor.

The present invention aims at providing an oil-filled electric cable, whose solid stratified insulation includes a plastic material so as to lower the dielectric losses and the dielectric constant without incurring the above-described drawbacks of cables including plastic material as part of the insulation.

One object of the present invention is an oil-filled electric cable comprising at least a conductor, a first semi-conductive screen which is in contact with the conductor and which is surrounded by a solid stratified insulation covered with a second semi-conductive screen, the whole being impregnated with an insulating fluid oil and enclosed within a metal sheath, said cable being characterized by the fact that the solid stratified insulation is entirely formed by independent and separate, alternate, overlapped layers formed by windings of cellulose paper tapes and windings of plastic material, film tapes where between the layers constituted by a winding of at least a cellulose paper tape, there is interposed a layer formed by a winding of at least a plastic material film tape.

According to a particular embodiment of a cable according to the present invention, the layer of the solid stratified insulation of the cable in direct contact with the first semi-conductive screen is constituted by at least a winding of a cellulose paper tape.

Further, according to a preferred embodiment of a cable according to the invention, in the solid stratified insulation, before its drying process and its impregnation with the insulating fluid oil, the cellulose paper tapes have a moisture content which will provide a shrinkage thereof upon drying which is substantially equal to the swelling of the plastic material, film tapes which takes place when insulation is impregnated with the insulating, fluid oil of the cable.

Another object of the present invention is a method for carrying out the pre-swelling of a plastic material film tape to be used for the formation of a solid stratified insulation of an oil-filled cable which is formed by independent, alternate, overlapped layers, constituted by a winding of at least a cellulose paper tape separated by other layers constituted by a winding of at least a tape of a plastic material film, said method being characterized by the fact of comprising the steps of:

(a) immersing the plastic material film tape in the insulating fluid oil which will be used for the impregnation of the cable for a time sufficient to reach at least the desired swelling; and (b) removing the insulating, fluid oil from the surface of the plastic material film tape.

Other objects and advantages of the present invention will be apparent from the following detailed description of the presently preferred embodiments thereof, which description should be considered in conjunction with the accompanying drawings in which:

FIGS. 1 and 2 show a single-core, oil-filled cable according to the invention, but the invention is not limited to single core cables since the present invention may be used with all types of oil-filled cables, such as, for example, multi-core, oil-filled cables and the so-called "pipe" cables.

Figure 1:
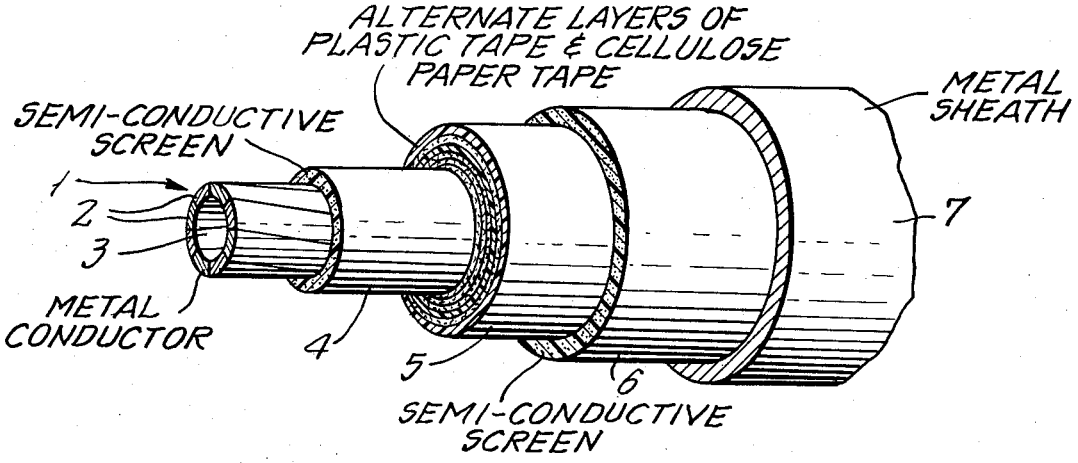
FIG. 1 is a perspective view of an oil-filled cable length according to the invention with parts partially broken away to show the structure.
Figure 2:
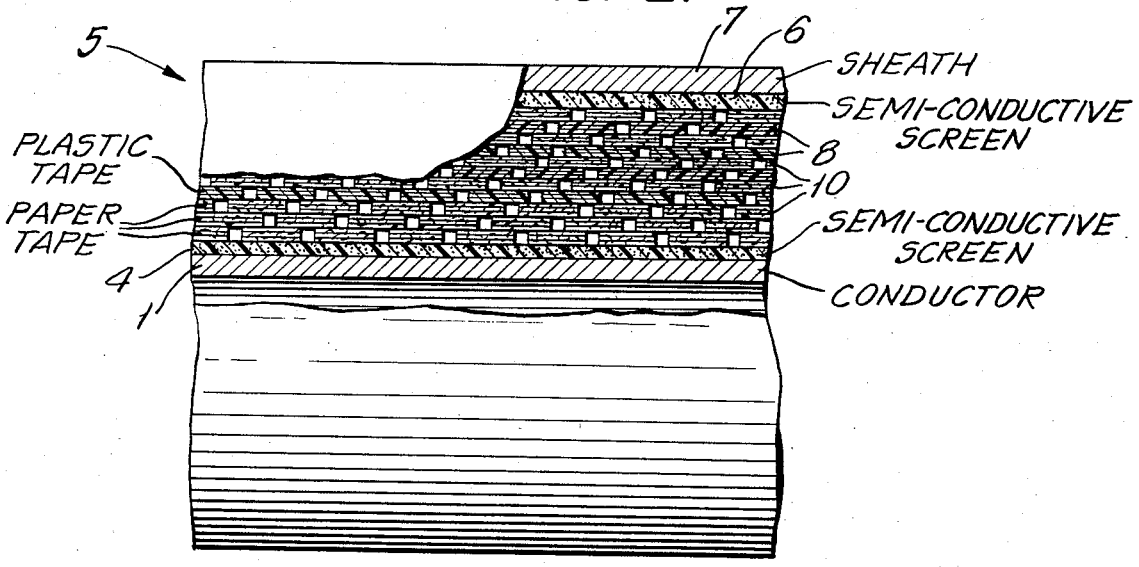
FIG. 2 is an axial half-section of a portion of the cable illustrated in FIG. 1.

As shown in FIGS. 1 and 2, the cable comprises a metallic conductor 1, for instance of copper, formed by a plurality of wires 2 stranded together so as to define a tubular cavity or duct 3 constituting the cable oil duct. Around the conductor 1, there is a first semi-conductive screen 4 obtained by winding semi-conductive, paper tapes, and in particular carbon paper tapes, around the conductor 1.

Around the semi-conductive screen 4 there is a solid, stratified insulation 5, which will be described in detail later on, and around the insulation 5, there is a second semi-conductive screen 6 formed in the same manner as the first semi-conductive screen 4, i.e. by windings of semi-conductive paper tapes, for example, of carbon paper.

All the previously described elements are enclosed within a metal sheath 7, for example, of lead or aluminum and are impregnated with an insulating, fluid oil which also fills the tubular cavity 3 constituting the cable oil duct.

In its more general aspects, the solid stratified insulation 5, according to the present invention, has the structure set forth hereinafter.

Figure 3:
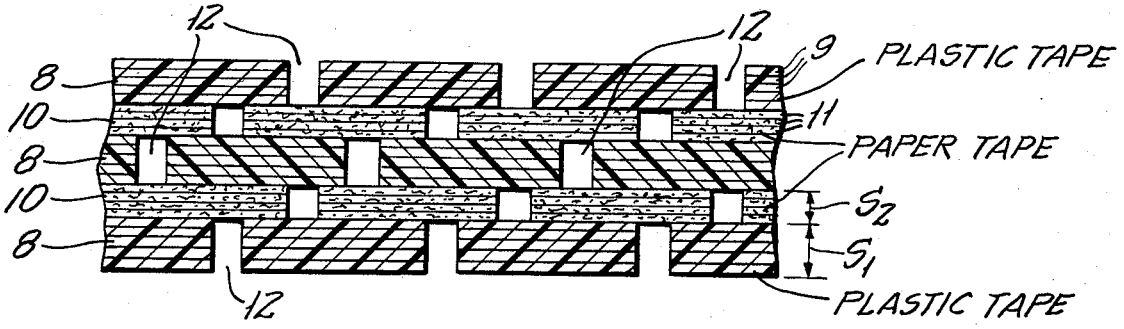
FIG. 3 is an enlarged, fragmentary, axial section of a portion of the solid stratified insulation of a cable according to the invention.

Said solid, stratified insulation 5 is entirely constituted by a plurality of independent, alternate, overlapped layers formed by windings of cellulose paper tapes and by windings of plastic material, film tapes. More specifically, as shown in the particular embodiment represented in FIG. 3, each inner layer 8, formed by a winding of at least a tape 9 of plastic material film, is surrounded, and therefore, separated from, the next adjacent layers 8 by layers 10, formed by a winding of at least a tape 11 of cellulose paper.

The windings of plastic tapes 9 forming the layers 8 and the windings of the paper tapes 11 forming the layers 10 are made according to the usual construction technique for cables so as to leave a space, called by those in the field a "gap", between the adjacent turns. In this way in the layers 8 there are the "gaps" 12 and in the layers 10 there are the "gaps" 13. All these gaps are filled with the insulating, fluid oil.

According to its more general aspects, the thickness $S_1$ of the tapes 9 of plastic material film and the thickness $S_2$ of the tapes 11 of cellulose paper can be of any values. However, in the case in which possible collapse of the tapes 9 of plastic material into the gaps 12 of the adjacent layers 10 formed by windings of cellulose paper tapes has to be avoided, it is preferred that the thickness of the layers 9 is greater than the thickness of the layers 11.

For example, using as plastic material, film tapes, high crystallinity polythene tapes, the thickness $S_1$ is of 0.15 mm, while the cellulose paper tapes have a total thickness $S_2$ of 0.11 mm.

For the tapes 9, the plastic material constituting them can be any plastic material having a dielectric loss factor or tg $\delta$ less than 1/5 of the dielectric loss factor of the cellulose paper tapes and a dielectric constant $\epsilon$ no greater than 30% of the dielectric constant of the impregnated cellulose tapes.

Plastic materials having these characteristics are, for example, the polyolefins, such as polyethylene and polypropylene, and the fluoridated plastic materials, such as polytetrafluoroethylene.

For the cellulose paper tapes 11, those having an apparent density (i.e. the density referred to the volume occupied by the paper whose structure comprises cellulose fibers and interposed empty spaces) comprised between 0.7 gr/cm$^3$ and 1 gr/cm$^3$ and having a permeability comprised between $2\times10^6$ and $2\times10^8$ Emanueli units are preferable.

In the particular embodiment of an oil-filled cable according to the invention, illustrated in FIGS. 1 and 2, the entire solid stratified insulation of the cable is constituted by independent alternate overlapped layers 8 and 10 previously described, with the exception of the layers nearest the first semi-conductive screen 4 surrounding the conductor 1 which is formed by windings of cellulose paper tapes only.

FIG. 2 shows three overlapped layers of cellulose paper tapes adjacent the first semi-conductive screen 4, but this is not intended to be limiting since, in general, for a cable according to the invention, the layers formed by windings of cellulose paper tapes, starting from the first semi-conductive screen 4, can be, for example, from 1 to 4.

For the formation of these layers 10 of windings of cellulose paper tapes which are adjacent the first semi-conductive screen 4, it is preferable that apparent density of the tapes is 0.85 gr/cm$^3$ and their permeability is about $10^7$ Emanueli units.

As previously stated, the main characteristic of an oil-filled cable according to the invention is that of having the solid stratified insulation formed by independent, overlapped layers alternately constituted by layers of plastic material, wound, film tapes separated by layers of cellulose paper, wound tapes.

Another characteristic, although not limiting, of the preferred embodiment of an oil-filled cable according to the invention, is that in the solid stratified insulation of the cable, the cellulose paper tapes have, during the cable formation, a moisture content of a value which is a function of the swelling of the plastic material tapes caused by the insulating fluid oil used to impregnate the cables.

Because of the great variability of the types of cellulose paper tapes which can be used, the great variability of the types of plastic material film tapes and the types of the impregnating oils which can be used, it is impossible to give an exact mathematical expression for the relationship between moisture content of the paper tapes and the swelling of the plastic tapes.

The relation which should exist between the moisture content of the cellulose paper tapes and the amount of swelling of the plastic material, film tapes can be experimentally determined as described hereinafter.

The moisture content of the cellulose paper tapes must be of such a value that the reduction of their thicknesses during the drying process should be of a value equal to the increase of thickness which there will be in the plastic material, film tapes between the swollen thickness which they will have when the cable is finished and in use and the thicknes which they have on forming of the solid, stratified insulation. Thus, the paper tapes may have a low moisture content if the plastic tapes are caused to swell by immersing them in the insulating oil of the cable prior to winding the paper and plastic tapes around the shield 4. Conversely, if the plastic tapes are not pre-swollen, the paper tapes should have a higher moisture content if the plastic tapes are not to be exposed to the insulating oil until the cable is filled with oil.

For example, in one embodiment of an oil-filled cable according to the present invention, when the solid stratified insulation is formed, the cellulose paper tapes forming the layers 10 are, practically, in a dry condition, having a moisture content not higher than 2% by weight, whereas the plastic material, film tapes forming the layers 8 will have been previously swollen to the maximum thickness with the insulating fluid oil ultimately used to impregnate the cable.

Alternatively, when the solid stratified insulation of a cable is formed of layers having the previously indicated thickness values, the cellulose paper tapes forming the layers 10 may have a moisture content of, for example, 8% by weight, which produces a reduction of thickness of about 5% during the drying process. Depending on the plastic material and the selected insulating fluid oil, the plastic tapes are pre-swollen before application by an amount such that on reaching the maximum swelling after the filling of the cable with oil, an increase of thickness substantially equal to the reduction in thickness of the cellulose paper tapes is obtained. For example, when polyethylene is used for the plastic film tapes and dodecylbenzene is used as the cable oil, the pre-swelling of the tapes will be of the order of 3–4%.

It will be apparent from the foregoing that when the insulating, fluid oil is known, the shrinkage of paper tapes with moisture loss and the swelling of plastic tapes with such oil are known or measured and the desired thicknesses of the insulating layers has been determined from conventional considerations, the moisture content of the paper tape and the amount of pre-swelling of the plastic tape prior to applying the layers of such tapes around the screen 4 can be readily determined.

According to an alternate embodiment of a cable according to the invention, the cellulose paper tapes forming the layers 8 may have, on its forming, a moisture content lower than 2% by weight, whereas the tapes of plastic material, film may, as a practical matter, not be pre-swollen by selecting plastic materials which have little swelling when in contact with the usual insulating fluid oils for cables. For example, fluoridated plastic material, such as polytetrafluoroethylene, swells only a small amount when in contact with the usual insulating oils. Alternatively, other plastic material tapes may be used by selecting an insulating, fluid oil for impregnating the cable which are of the non-swelling type, such as, the compounds of silicone oils containing small quantities of aromatic hydrocarbons.

The pre-swelling of the plastic material, film tapes for the formation of the layers 8 of the solid stratified insulation of a cable according to the present invention may be obtained according to a method which is also an object of the present invention.

The method according to the invention for carrying out the pre-swelling of the plastic material film tapes comprises the following steps which follow each other as indicated:

a. A plastic material film tape is completely immersed into the insulating fluid oil preferably heated, for instance at a temperature of 80° C. and left in contact with the said insulating fluid oil for a pre-established time which is a function of the amount of swelling which it has been determined to have; and b. After having removed the tape from the oil bath, all the insulating fluid oil existing on the surface of the tape itself is removed.

The step of removing the insulating fluid oil from the surface of the plastic material, film tape, after the tape is removed from the insulating, fluid oil bath, can be carried out mechanically, for example, by means of brushes, or chemically, by means of a detergent for the insulating fluid oil.

In this latter case the method according to the present invention comprises the steps of:

(1) taking away through a washing process with a detergent all the insulating fluid oil existing on the surface of the tape itself; and (2) removing, by a stream of air, the detergent remaining in contact with the tape.

Figure 4:
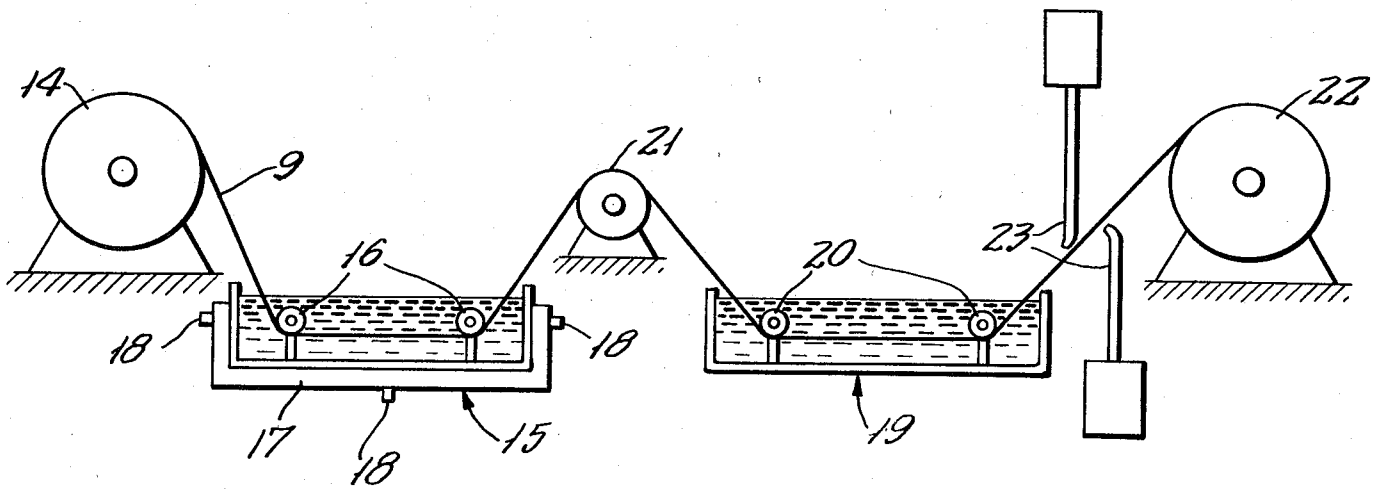
FIG. 4 is a schematic, side elevation view of apparatus for carrying out the pre-swelling of a plastic material film tape for accomplishing the method according to the invention.

For carrying into effect the above-described method, it is possible to use the apparatus shown in FIG. 4.

As shown in FIG. 4, a reel 14 carries a tape 9 of plastic material, for example, polypropylene, intended for the formation of the layers 8 of a solid stratified insulation of a cable according to the invention.

Downstream of the reel 14, there is a tank 15 filled with a hot, insulating, fluid oil, for example, a fluid alkylate at a temperature of 80° C.

Within the tank 15, there are two rollers 16 freely rotatable about their axes and maintained at a distance from the bottom of the tank 15 itself.

Around the tank 15, there is a heating jacket 17 provided with inlet and outlet conduits 18 for a heating fluid.

Downstream of the tank 15, there is a tank 19 filled with a detergent liquid, for example, petroleum ether, and within the tank 19 there are provided two rollers 20 freely rotatable about their axes and maintained at a distance from the bottom of the tank 19 itself.

Between the tank 15 and the tank 19 there is a return roller 21 freely rotatable about its axes to permit the removal of the tape 9 from the tank 15 and the forwarding of the same into the tank 19.

Downstream of the tank 19, there is a collecting reel 22 and between these elements there are nozzles 23 connected to tanks of air under pressure to remove any trace of detergent from the surface of the tape 9 coming out of the tank 19.

Motor driving means, not shown in the FIG. 4, are connected to the previously described devices, in a conventional manner, in order to move the plastic material film tape 9 at an advancing speed of such a value as to leave the polypropylene film in contact with the fluid alkylate for a period of hours which is sufficient for obtaining up to the maximum pre-swelling.

In fact, when the tape 9 comes off the reel 14 and penetrates into the tank 15 filled with a hot insulating fluid oil, it passes below the rollers 16 so as to be entirely immersed in the insulating fluid oil. The tape 9, coming out of the tank 15, passes over the roller 21 from which it is conveyed into the tank 19 filled with a fluid detergent.

In the tank 19, the tape 9 passes below the rollers 20 which cause it to remain immersed in the detergent fluid. After coming out of the tank 19, the tape 9, before being collected on the reel 22 passes between the nozzles 23 emitting air which takes away any trace of detergent from the surface of the tape itself. On the reel 22, the tape, treated as indicated, is in the desired pre-swollen condition.

The tape 9 may have a width equal to that determined for the formation of the layers 8 of the solid stratified insulation of an oil-filled cable according to the invention, but if desired, the treatment may be made on a tape of transverse dimensions equal to a multiple of the width of the tape 9. In the latter case, a cutter should be provided before or after the reel 22 to provide, from the coil 22, rolls of tape 9 of the desired width.

From the previously indicated description and from the following considerations, it will be understood that, by means of the present invention the objects of the invention are achieved.

In fact, the use of independent or separate and alternate layers of windings of cellulose paper tapes and plastic material, film tapes for the formation of the solid stratified insulation of a cable permits, first of all, the avoidance of the risk of having wrinkles in the tapes. In the prior art method, it is difficult to avoid the formation of wrinkles because the solid stratified insulation of the cable is formed by windings of tapes of cellulose paper-plastic film laminates closely joined to one another.

Moreover, the use of distinct layers formed by windings of plastic material, film tapes separated by separate layers of windings of cellulose paper tapes permits, with respect to the use of tapes of cellulose paper-plastic film laminates, a reduction of the dimensions of the gaps filled with oil in a cable stratified insulation both because the distinct tapes have a thickness smaller than those of a laminate formed with them and because the use of distinct tapes permits the latter to have a thickness smaller than the ones required for the formation of laminates.

In fact, whereas in the usual laminates in which the plastic film is enclosed and secured to two paper layers, the minimum thickness that can be reached is of about 0.12 mm, and therefore, the gaps have this value as minimum dimension. By means of the present invention, it is possible to obtain thicknesses of gaps no more than 0.06–0.08 mm for a winding of plastic material film alternating with two adjacent independent layers, each latter layer being formed by a winding of a tape of cellulose paper.

This fact, producing a reduction of the thickness of the gaps between the tapes of a solid stratified insulation filled with oil, provides an increase of the dielectric strength, a lowering of the dielectric losses of the cable and a lowering of the electrophoresis losses in the insulating fluid oil filling said gaps.

A very good flexibility is obtained by means of an oil-filled cable according to the present invention due to the flexibility of the cable solid stratified insulation which results from the insulation being formed by alternate layers of windings of cellulose paper tapes and plastic material, film tapes.

The flexibility of an oil-filled cable according to the invention is better than that of the known cables in which the solid stratified insulation is formed by windings of tapes of cellulose paper-plastic film laminate bound to one another where the plastic film is sandwiched between two layers of cellulose paper so as to be comparable in properties with the known oil-filled cables having the solid stratified insulation formed only by windings of cellulose paper tapes.

The reason is that in an oil-filled cable according to the invention the friction coefficient between the layers of cellulose paper and the plastic material is lower than the friction coefficient between the above-mentioned laminated tapes or between the paper tapes.

The forming of the solid stratified insulation of an oil-filled cable according to the present invention by means of plastic material, film tapes previously swollen with the insulating fluid oil intended for the impregnation of the cable, permits the avoidance of the uncontrolled swelling of the tapes themselves in the already formed solid stratified insulation and thereby avoids a reduction in the cable flexibility.

Finally, the formation, with cellulose paper tapes, of those layers of the solid stratified insulation nearest the first semi-conductive screen covering the cable conductor, where the electric field has a greater intensity, permits the elimination of the risks resulting from the unavoidable imperfections of the plastic material film tapes, and a better dielectric strength is thus obtained for an oil-filled cable.

Although preferred embodiments of the present invention have been described and illustrated, it will be apparent to those skilled in the art that various modifications may be made without departing from the principles of the invention.

The embodiments of the invention in which an exclusive property or priviledge is claimed are defined as follows:

1. An oil-filled electric cable comprising at least a conductor, a semi-conductive screen around and in contact with said conductor, solid, stratified insulation around said screen, a metal sheath around said insulation and an insulating oil impregnating said insulation, wherein the improvement comprises a plurality of alternate, separate and different layers forming said insulation, at least one of said layers consisting essentially of a plurality of superimposed and contacting windings of plastic tape with smooth surfaces and the layers at opposite sides of and next adjacent to said one layer consisting essentially of a plurality of superimposed and contacting windings of cellulose paper tape with smooth surfaces.

2. An oil-filled electric cable as set forth in claim 1 wherein said one layer is without cellulose paper tape therein.

3. An oil-filled electric cable as set forth in claim 1 wherein said layers are separable from each other.

4. An oil-filled electric cable as set forth in claim wherein said tape of plastic material is made of a material which swells when in contact with said insulating oil.

5. An oil-filled electric cable as set forth in claim 1 wherein one of said layers consisting essentially of a plurality of superimposed and contacting windings of cellulose paper tape contacts said semi-conductive screen.

6. An oil-filled electric cable as set forth in claim 1 wherein successive turns of each layer are axially spaced from each other to provide gaps between the sides of the turns.

7. An oil-filled electric cable as set forth in claim 1 wherein said layers are substantially free of radial compression caused by swelling of the plastic tape and shrinkage of the cellulose paper tape.

8. An oil-filled electric cable as set forth in claim 6 wherein the turns of each layer overlap the gaps between the turns in the next adjacent layer.

* * * * *

UNITED STATES PATENT AND TRADEMARK OFFICE

CERTIFICATE OF CORRECTION

PATENT NO. : 4,602,121

DATED : July 22,1986

INVENTOR(S) : Priaroggia

It is certified that error appears in the above-identified patent and that said Letters Patent is hereby corrected as shown below:

Col. 10, line 9, after "claim" insert --1--.

Signed and Sealed this

Ninth Day of February, 1988

*Attest:*

DONALD J. QUIGG

*Attesting Officer*

*Commissioner of Patents and Trademarks*